US008227394B2

(12) United States Patent
Zhu et al.

(10) Patent No.: US 8,227,394 B2
(45) **Date of Patent: *Jul. 24, 2012**

(54) COMPOSITION OF A CLEANING MATERIAL FOR PARTICLE REMOVAL

(75) Inventors: Ji Zhu, El Cerrito, CA (US); Arjun Mendiratta, Berkely, CA (US); David Mui, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 54 days.

This patent is subject to a terminal disclaimer.

(21) Appl. No.: 12/267,345

(22) Filed: Nov. 7, 2008

(65) Prior Publication Data

US 2010/0120647 A1 May 13, 2010

(51) Int. Cl.
*C11D 3/26* (2006.01)
*C11D 3/37* (2006.01)
*C11D 3/43* (2006.01)

(52) U.S. Cl. ..... 510/175; 510/434; 510/475; 510/477

(58) Field of Classification Search ..... 510/175, 510/434, 475, 477

See application file for complete search history.

(56) References Cited

U.S. PATENT DOCUMENTS

2005/0148186 A1* 7/2005 Jung et al. ..... 438/692
2006/0163530 A1* 7/2006 Liu ..... 252/79.1

* cited by examiner

*Primary Examiner* — Brian P Mruk
(74) *Attorney, Agent, or Firm* — Martine Penilla Group, LLP

(57) ABSTRACT

The embodiments of the present invention provide improved materials for cleaning patterned substrates with fine features. The cleaning materials have advantages in cleaning patterned substrates with fine features without substantially damaging the features. The cleaning materials are fluid, either in liquid phase, or in liquid/gas phase, and deform around device features; therefore, the cleaning materials do not substantially damage the device features or reduce damage all together. To assist removing of particles from the wafer (or substrate) surfaces, the polymeric compound of the polymers can contain a polar functional group, which can establish polar-polar molecular interaction and hydrogen bonds with hydrolyzed particles on the wafer surface. The polymers of a polymeric compound(s) with a large molecular weight form long polymer chains and network. The long polymer chains and/or polymer network show superior capabilities of capturing and entrapping contaminants, in comparison to conventional cleaning materials. The polymeric compound(s) of the polymers may also include a functional group that carries charge in the cleaning solution. The charge of the functional group of the polymers improves the particle removal efficiency.

20 Claims, 9 Drawing Sheets

PAM - polyacrylamide

PAA - polyacrylic acid

PAM - polyacrylamide

PAA - polyacrylic acid

PAM - polyacrylamide

PAA - polyacrylic acid

PH-PAM - partially hydrolyzed polyacrylamide

COMPOSITION OF A CLEANING MATERIAL FOR PARTICLE REMOVAL

CROSS REFERENCE TO RELATED APPLICATIONS

This application is related to U.S. patent application Ser. No. 12/131,654, filed on Jun. 2, 2008, and entitled "Materials for Particle Removal by Single-Phase and Two-Phase Media," and U.S. patent application Ser. No. 12/165,577, filed on Jun. 30, 2008, and entitled "Single Substrate Processing Head for Particle Removal Using Low Viscosity Fluid." This application is related to U.S. patent application Ser. No. 12/267,362, filed on the same day as this application, entitled "Composition and Application of a Two-Phase Contaminant Removal Medium." The disclosure of each of these related applications is incorporated herein by reference for all purposes.

BACKGROUND

In the fabrication of semiconductor devices such as integrated circuits, memory cells, and the like, a series of manufacturing operations are performed to define features on semiconductor wafers ("wafers"). The wafers (or substrates) include integrated circuit devices in the form of multi-level structures defined on a silicon substrate. At a substrate level, transistor devices with diffusion regions are formed. In subsequent levels, interconnect metallization lines are patterned and electrically connected to the transistor devices to define a desired integrated circuit device. Also, patterned conductive layers are insulated from other conductive layers by dielectric materials.

During the series of manufacturing operations, the wafer surface is exposed to various types of contaminants. Essentially any material present in a manufacturing operation is a potential source of contamination. For example, sources of contamination may include process gases, chemicals, deposition materials, and liquids, among others. The various contaminants may deposit on the wafer surface in particulate form. If the particulate contamination is not removed, the devices within the vicinity of the contamination will likely be inoperable. Thus, it is necessary to clean contaminants from the wafer surface in a substantially complete manner without damaging the features defined on the wafer. However, the size of particulate contamination is often on the order of the critical dimension size of features fabricated on the wafer. Removal of such small particulate contamination without adversely affecting the features on the wafer can be quite difficult.

Conventional wafer cleaning methods have relied heavily on mechanical force to remove particulate contamination from the wafer surface. As feature sizes continue to decrease and become more fragile, the probability of feature damage due to application of mechanical forces on the wafer surface increases. For example, features having high aspect ratios are vulnerable to toppling or breaking when impacted by a sufficient mechanical force. To further complicate the cleaning problem, the move toward reduced feature sizes also causes a reduction in the size of particulate contamination. Particulate contamination of sufficiently small size can find its way into difficult to reach areas on the wafer surface, such as in a trench surrounded by high aspect ratio features. Thus, efficient and non-damaging removal of contaminants during modern semiconductor fabrication represents a continuing challenge to be met by continuing advances in wafer cleaning technology. It should be appreciated that the manufacturing operations for flat panel displays suffer from the same shortcomings of the integrated circuit manufacturing discussed above.

In view of the foregoing, there is a need for apparatus and methods of cleaning patterned wafers that are effective in removing contaminants and do not damage the features on the patterned wafers.

SUMMARY

Broadly speaking, the embodiments of the present invention provide improved materials, apparatus, and methods for cleaning wafer surfaces, especially surfaces of patterned wafers (or substrates). The cleaning materials, apparatus, and methods discussed above have advantages in cleaning patterned substrates with fine features without substantially damaging the features. The cleaning materials are fluid, either in liquid phase, or in liquid/gas dual phase, and deform around device features; therefore, the cleaning materials do not substantially damage the device features or reduce damage all together. The cleaning materials, containing polymers of one or more polymeric compounds with large molecular weight, capture the particles (or contaminants) on the substrate. For polymers made from one monomer, the polymers contain one polymeric compound. For polymers made from more than one monomers, such as copolymers or a mixture of polymers, the polymers contain more than one polymeric compound. To assist removing of particles from the wafer (or substrate) surfaces, the polymeric compound of the polymers can contain a polar functional group, which can establish polar-polar molecular interaction with hydrolyzed particles on the wafer surface. In addition, the polar functional group can also establish hydrogen bonds with the hydrolyzed particles on the wafer surface. The van der Waals forces between the polymers and the particles help remove the particles from the wafer surface.

In addition, the cleaning materials entrap the contaminants and do not return the contaminants to the substrate surface. The polymers of a polymeric compound(s) with a large molecular weight form long polymer chains, which can also be cross-linked to form a network (or polymeric network). The long polymer chains and/or polymer network show superior capabilities of capturing and entrapping contaminants, in comparison to conventional cleaning materials. As a result, cleaning materials, in fluid form, including such polymers show excellent particle removal performance. The captured or entrapped contaminants are then removed from the surface of the substrate.

The polymeric compound(s) of the polymers may also include a functional group that carries charge in the cleaning solution. The charge of the functional group of the polymers repels one another and helps the polymeric chains and network to be more spread out and hence improves the particle removal efficiency.

As discussed above, the polymers can be cross-linked. However, the extent of cross-link is relatively limited to avoid making the polymers too hard or rigid, which would prevent the polymers from being soluble in a solvent and being deformed around device features on the substrate surface.

It should be appreciated that the present invention can be implemented in numerous ways, including as a system, a method and a chamber. Several inventive embodiments of the present invention are described below.

In one embodiment, a cleaning material applied on a surface of a substrate for removing particles from the surface is provided. The cleaning material includes a solvent, and a buffering agent to change a potential of hydrogen (pH) value of the cleaning material, wherein the buffering agent and the solvent form a cleaning solution. The cleaning material also includes polymers of a polymeric compound with a molecular weight greater than 10,000 g/mol. The polymers become soluble in the cleaning solution to form the cleaning material. The solubilized polymers form long polymeric chains and network to capture and entrap at least some of the particles from the surface of the substrate. The polymeric compound has a polar functional group. The polar functional group of the polymeric compound establishes van der Waals force with the particles hydrolyzed in the solvent to help remove the particles from the surface of the substrate.

In another embodiment, a cleaning material applied on a surface of a substrate for removing particles from the surface is provided. The cleaning material includes water; and a buffering agent to change a potential of hydrogen (pH) value of the cleaning material. The buffering agent and the water form an aqueous cleaning solution. The cleaning material also includes polymers of a polymeric compound with a molecular weight greater than 10,000 g/mol. The polymers become soluble in the aqueous cleaning solution to form the cleaning material. The solubilized polymers form long polymeric chains and network to capture and entrap at least some of the particles from the surface of the substrate. The polymeric compound has a functional group carrying charge in the aqueous cleaning solution. The charge carried by the functional group of the polymeric compound improves particle removal efficiency by making the polymeric chains and network more spread out in the aqueous cleaning solution.

In yet another embodiment, a cleaning material applied on a surface of a substrate for removing particles from the surface is provided. The cleaning material includes water, and a buffering agent to change a potential of hydrogen (pH) value of the cleaning material. The buffering agent and the water form an aqueous cleaning solution. The cleaning material also includes polymers of a polymeric compound with a molecular weight greater than 10,000 g/mol. The polymers become soluble in the aqueous cleaning solution to form the cleaning material. The solubilized polymers form long polymeric chains and network to capture and entrap at least some of the particles from the surface of the substrate. The polymeric compound has a functional group carrying charge in the aqueous cleaning solution. The charge carried by the functional group of the polymeric compound improves particle removal efficiency by making the polymeric chains and network more spread out in the aqueous cleaning solution. The polymeric compound has a polar functional group. The polar functional group of the polymeric compound establishes van der Waals force with the particles hydrolyzed in the aqueous cleaning solution to help remove the particles from the surface of the substrate.

BRIEF DESCRIPTION OF THE DRAWINGS

The present invention will be readily understood by the following detailed description in conjunction with the accompanying drawings, and like reference numerals designate like structural elements.

DETAILED DESCRIPTION

Figure 1:
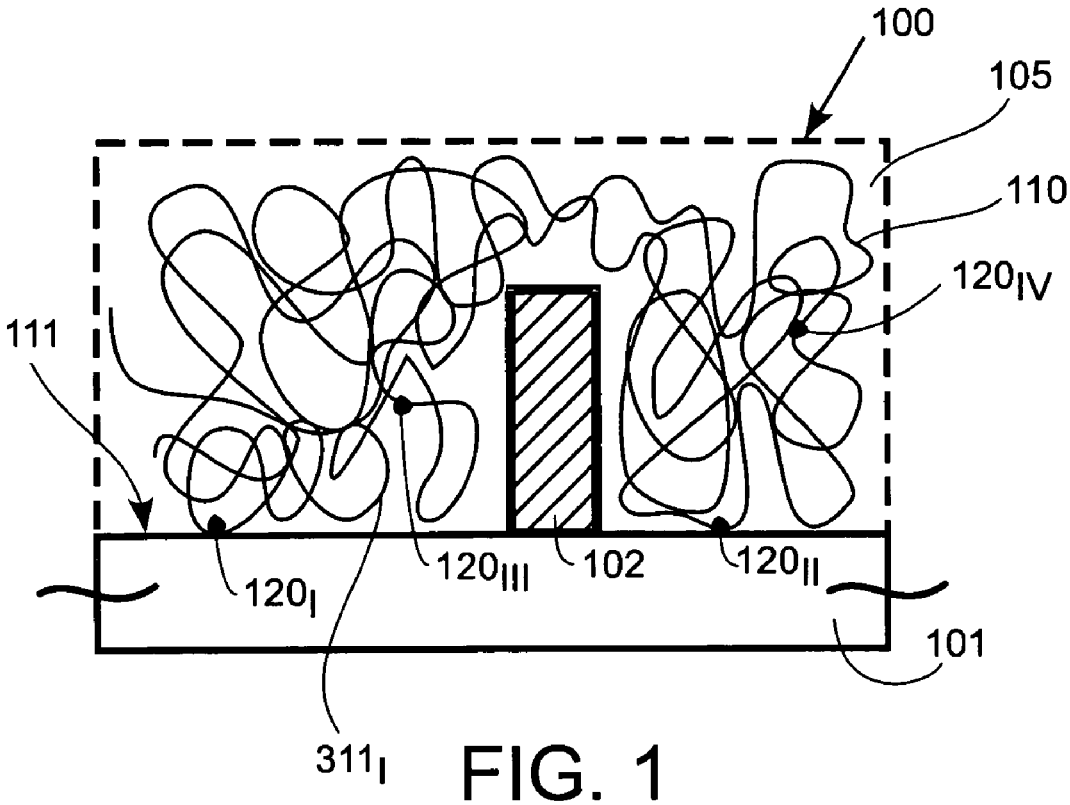
FIG. 1 shows a cleaning material containing polymers of a polymeric compound with large molecular weight dissolved dispensed on a substrate surface to clean contaminants on the substrate surface, in accordance with one embodiment of the present invention.

Embodiments of materials, methods and apparatus for cleaning wafer surfaces without damaging surface features are described. The cleaning materials, apparatus, and methods discussed herein have advantages in cleaning patterned substrates with fine features without damaging the features. The cleaning materials are fluid, either in liquid phase, or in liquid/gas phase, and deform around device features; therefore, the cleaning materials do not damage the device features. The cleaning materials, containing polymers of a polymeric compound with large molecular weight, capture the contaminants on the substrate. In addition, the cleaning materials entrap the contaminants and do not return the contaminants to the substrate surface. The polymers of a polymeric compound with large molecular weight form long polymer chains, which can also be cross-linked to form a network (or polymeric network). The length of the polymer chains for polymers that are not substantially cross-linked or almost not cross-linked can be estimated by dividing the molecular weight of the polymers by the molecular weight of the monomeric species (length~(molecular weight of polymer)/(molecular weight of monomer)). The long polymer chains and/or polymer network show superior capabilities of capturing and entrapping contaminants, in comparison to conventional cleaning materials.

It will be obvious, however, to one skilled in the art, that the present invention may be practiced without some or all of these specific details. In other instances, well known process operations have not been described in detail in order not to unnecessarily obscure the present invention.

The embodiments described herein provide cleaning materials and cleaning methods that are effective in removing contaminants and do not damage the features on the patterned wafers, some of which may contain high aspect ratio features. While the embodiments provide specific examples related to semiconductor cleaning applications, these cleaning applications might be extended to any technology requiring the removal of contaminants from a substrate.

For advanced technologies, such as 65 nm, 45 nm, 32 nm, 22 nm, and, 16 nm technology nodes, the widths of the device structures is equal to or less than 65 nm. The widths of device structures are scaled continuously down with each technology node to fit more devices on the limited surface area of chips. The heights of the device structures, such as height of device structure, in general do not scale down proportionally with the width of the device features due to concern of resistivities. For conductive structures, such as polysilicon lines and metal interconnect, narrowing the widths and heights of structures would increase the resistivities too high to cause significant RC delay and generate too much heat for the conductive structures. As a result, device structures, such as structure, would have high aspect ratio, which make them prone to damage by force applied on the structure. In one embodiment, the aspect ratio of the device structure can be in the range of about 2 or greater. The force applied on the structure includes force used to assist in removing particles (or contaminants) from substrate surface, which can be a result of any relative motion between the cleaning material and the substrate surface or can be from dispensing of cleaning material or rinsing liquid on the substrate surface.

The decreased widths of device structures and the relatively high aspect ratios of device structures make the device structures prone to breakage under applied force or accumulated energy under applied force. The damaged device structures become a particle source to reduce yield. In addition, the damage device structures also can become inoperable due to the damage.

FIG. 1 shows a liquid cleaning material 100, which contains a cleaning solution 105 containing polymers 110 with large molecular weight dissolved in the cleaning liquid 105, in accordance with one embodiment of the present invention. In one embodiment, the liquid cleaning material 100 is in liquid form. In another embodiment, the cleaning material 100 is a gel or a sol. The cleaning material 100, when applied on a substrate with particles on the substrate surface 111, can capture and remove particles, such as particles $\mathbf{120}_I$, $\mathbf{120}_{II}$, from the substrate surface 111 of substrate 101. In addition, the cleaning material 100 entraps particles that are removed from the substrate surface 111, such as particles $\mathbf{120}_I$, $\mathbf{120}_{II}$, or are present in the cleaning material 100, such as particles $\mathbf{120}_{III}$, $\mathbf{120}_{IV}$, to prevent them from falling or depositing on the substrate surface 111. Details of a cleaning material containing polymers with a large molecular weight have been described in commonly assigned U.S. patent application Ser. No. 12/131,654, filed on Jun. 2, 2008, and entitled "Materials for Particle Removal by Single-Phase and Two-Phase Media," which is incorporated herein by reference in its entirety.

To enable capturing particles, such as particles $\mathbf{120}_I$, $\mathbf{120}_{II}$, on the substrate surface 111 to remove them from the substrate surface 111, the polymers 110 should make contact with the particles, such as particles $\mathbf{120}_I$, $\mathbf{120}_{II}$, on the substrate surface and the attractive forces between the polymers and the particles should be stronger than the forces between the particles and the substrate surface 111.

Figure 2A:
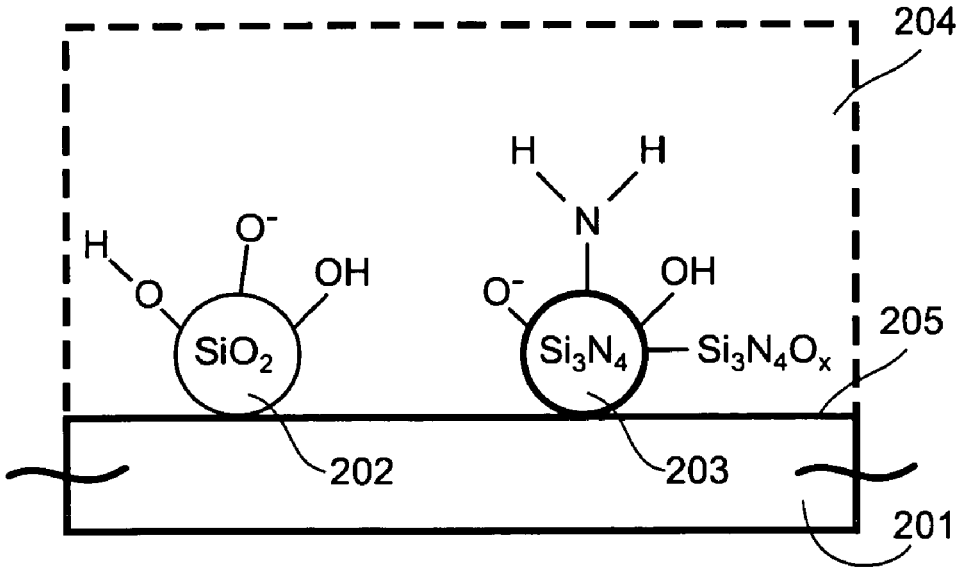
FIG. 2A shows the prevalent surface chemical groups of a particle of silicon oxide and a particle of silicon nitride on a substrate surface in an aqueous solution, in accordance with one embodiment of the present invention.

Examples of common particles on the substrate surface include, but not limited to, silicon oxide ($SiO_2$) and silicon nitride ($Si_3N_4$), whose surface could also be oxidized to contain oxygen ($Si_3N_4O_X$). FIG. 2A shows a particle 202 of silicon oxide and a particle of silicon nitride 203 on a surface 205 of a substrate 201 in an aqueous solution 204, in accordance with one embodiment of the present invention. Silicon oxide ($SiO_2$) and oxidized silicon nitride ($Si_3N_4O_X$) are both hydrophilic. The oxygen atoms (O) on surfaces of silicon oxide ($SiO_2$) and silicon nitride ($Si_3N_4O_X$) particles, and nitrogen atoms (N) on surface of silicon nitride particles can be hydrolyzed to form O—H and H—N—H on the particle surfaces or stay negatively charged ($O^-$) on the surfaces of the particle, as shown in FIG. 2A.

If the polymers in the cleaning material contain polar functional groups, the polymers can establish polar-polar molecular interaction with the polar OH, $NH_2$, and $O^-$ groups on the particle surfaces. Polar-polar molecular interaction is a van der Waals interaction and can generate attractive force between two compounds. Further, the polar functional groups of the polymers can establish hydrogen bonds with the polar OH, $NH_2$, and $O^-$ groups on the particle surfaces. Hydrogen bond results from a dipole-dipole force between an electronegative atom, such as O and N atoms in silicon oxide and oxidized silicon nitride, and a hydrogen atom bonded to nitrogen, oxygen, or halogen (such as fluorine), such as the hydrogen atoms bonded to oxygen in water. The hydrogen bond is a very strong fixed dipole-dipole van der Waals-Keesom force, but weaker than covalent, ionic and metallic bonds.

Figure 2B:
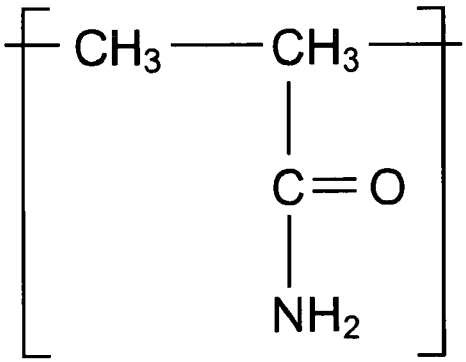
FIG. 2B shows chemical structures of polyacrylamide (PAM) and polyacrylic acid (PAA), in accordance with one embodiment of the present invention.
Figure 2B:
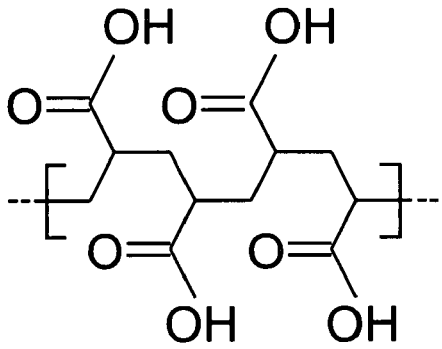
Figure 2C:
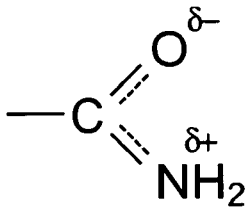
FIG. 2C shows the resonance structures of PAM with functional group —$CONH_2$ and of PAA with functional group —COOH, in accordance with one embodiment of the present invention.
Figure 2C:
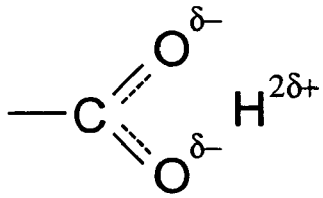

FIG. 2B shows chemical structures of two exemplary polymeric compounds, polyacrylamide (PAM), which has a functional group —$CONH_2$, and polyacrylic acid (PAA), which has a functional group —COOH. FIG. 2C shows the resonance structures of PAM with functional group —$CONH_2$ and of PAA with functional group —COOH. The C═O and —$NH_2$ polar groups of PAM and COO— polar group of PAA are active polar groups to interact with OH, —$NH_2$, and $O^-$ groups on the particle surfaces.

Figure 2D:
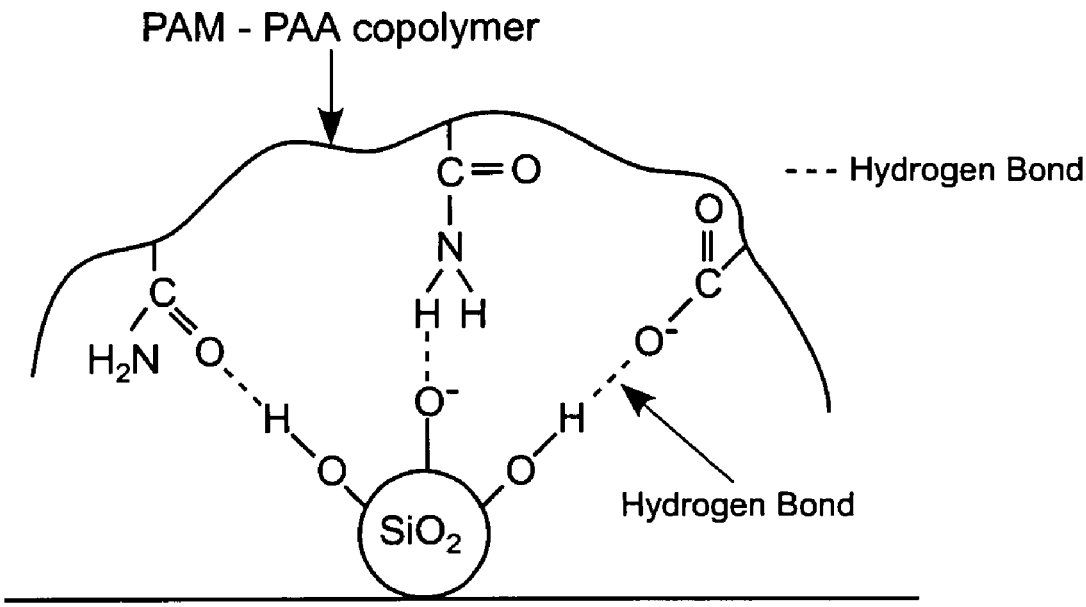
FIG. 2D shows a bonding scheme of a copolymer made of PAM and PAA with hydrolyzed silicon oxide particle in an aqueous solution, in accordance with one embodiment of the present invention.
Figure 2E:
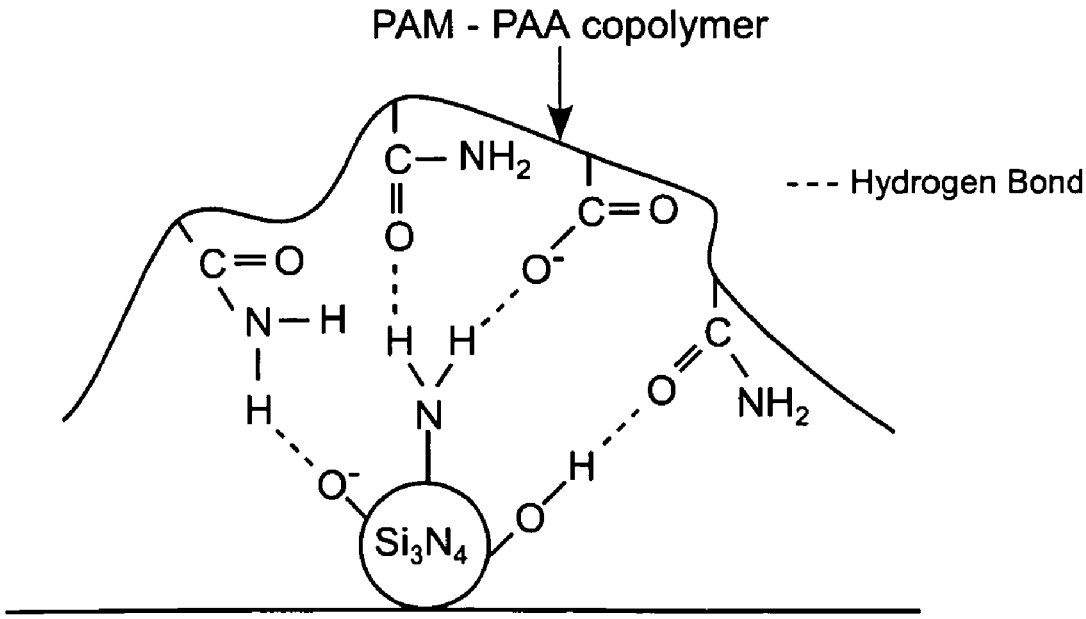
FIG. 2E shows a bonding scheme of a copolymer made of PAM and PAA with hydrolyzed silicon nitride particle in an aqueous solution, in accordance with one embodiment of the present invention.

FIG. 2D shows a bonding scheme of a copolymer made of PAM and PAA with hydrolyzed silicon oxide particle in an aqueous solution, in accordance with one embodiment of the present invention. The particle surface has polar groups OH and O—, which form hydrogen bonds with C═O and —$NH_2$ polar groups of PAM and COO— polar group of PAA. FIG. 2E shows a bonding scheme of a copolymer made of PAM and PAA with hydrolyzed silicon nitride particle in an aqueous solution, in accordance with one embodiment of the present invention. The particle surface has polar groups OH, NH2, and O—, which form hydrogen bonds with C═O and —$NH_2$ polar groups of PAM and COO— polar group of PAA.

The polar-polar molecular interaction and/or hydrogen bonds between the polymers and the oxygen and nitrogen establish strong van der Waals forces between the polymers and the particles. Such strong van der Waals forces help pull the particles away from the surface. If the van der Waals forces are strong enough, they can overcome the attractive forces between the particles and the substrate surface and lift the particles off the substrate surface.

Examples of polar functional groups that the polymers can have to establish the polar-polar molecular interaction and/or hydrogen bonding described above include, but not limited to, amine, amide, hydroxyl, carbonyl, sulfonyl, sulfinyl, sulfhydryl groups.

Besides having polar groups in the molecular structure of the polymers, having a large molecular weight to form polymer chains and a polymer network is also important. The molecular weight of polymers used in the cleaning material can affect the particle removal efficiency (PRE). PRE is measured by using particle monitor substrates, which are purposely deposited with silicon nitride particles with varying sizes. In this study, only particle sizes between 90 nm and 1 μm are measured. PRE is calculated by equation (1) listed below:

$$PRE=(\text{Pre-clean counts}-\text{Post-clean counts})/\text{Pre-clean counts} \quad (1)$$

Figure 3A:
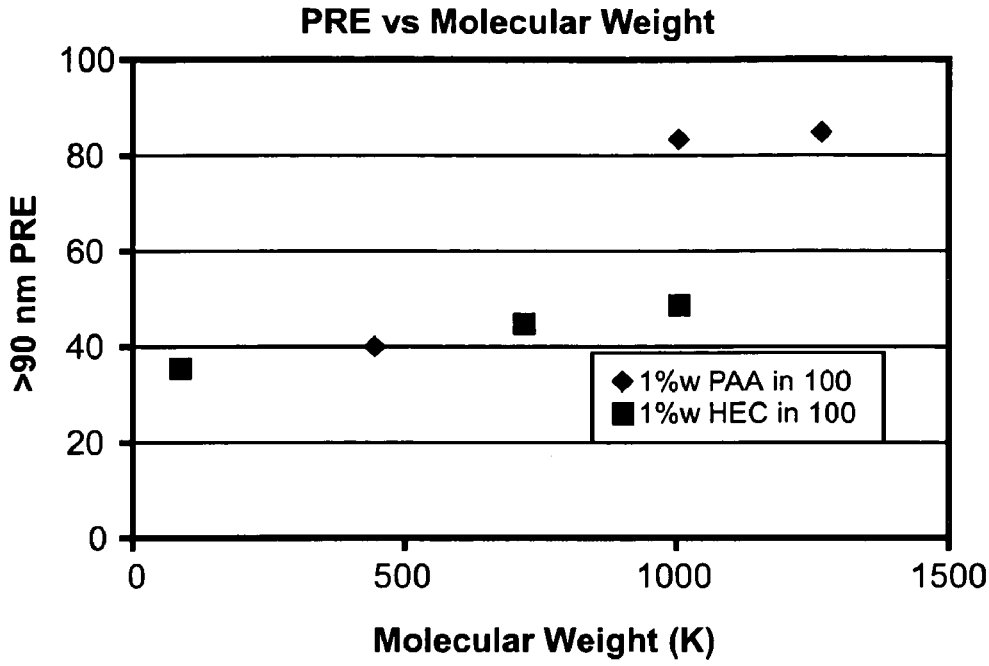
FIG. 3A shows a diagram of particle removal efficiencies (PREs) as a function of molecular weight for cleaning materials containing PAA and HEC (hydroxyethyl cellulose), in accordance with one embodiment of the present invention.

FIG. 3A shows a graph of PRE of cleaning materials with polymers with varying molecular weights. The PRE measures the cleaning efficiency of silicon nitride particles deposited on surfaces of substrates that are greater than 90 nm by cleaning materials made of polyacrylic acid (PAA) or hedroxyethyl cellulose (HEC) in an "100" cleaning solution. A solution that contains 1 wt % of ADS, 0.44 wt % of NH3, and 0.4 wt % of citric acid is called solution "100". The weight percent of PAA or HEC polymers in the cleaning materials are about 1%.

The data in FIG. 3A show that PRE increases with molecular weight of HEC from about 35% for 100,000 g/mol to about 50% for 1M (or 1,000,000) g/mol. Data in FIG. 3A also show that PRE increases with molecular weight for PAA from about 40% for 500,000 g/mol to about 85% for 1M g/mol. However, PRE does not change much between 1M g/mol and 1.25M g/mol for PAA to stay about 85%.

Figure 3B:
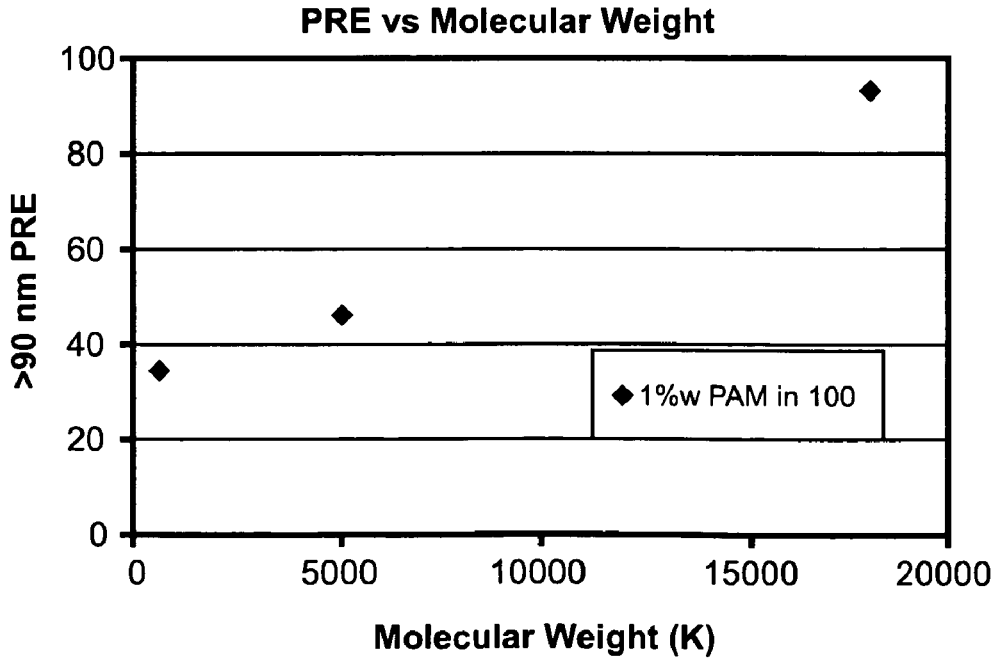
FIG. 3B shows a diagram of PREs as a function of molecular weight for cleaning materials containing PAM, in accordance with one embodiment of the present invention.

FIG. 3B shows a graph of PRE of cleaning materials made with 1% (weight %) of PAM in "100" as a function of the molecular weight of PAM. The data in FIG. 3B show that PREs increase with molecular weight of PAM from about 35% for 500,000 g/mol to about 95% for 18M g/mol.

The data in FIGS. 3A and 3B show that polymers with large molecular weight, such as ≧500,000 g/mol for PAA, ≧700,000 g/mol for HEC, and ≧5M g/mol for PAM, are needed to have good PREs. Polymers with large molecular weight, such as >100,000 g/mol, allow polymers with form long polymer chains and polymer networks, which capture and trap particles that are deposited on the substrate surface and suspended cleaning material. As described above, when the polymers come in contact with the particles on the substrate surface, the polar groups on the polymers form hydrogen bonds and establish polar-polar molecular interactions with particles on the substrate surface. The van der Waals force between the particles and the polymers are strong enough to lift the particles from the substrate surface. The lifted particles are trapped and suspended in the polymeric network and chains formed by the polymers. The trapping and suspending of the particles prevent the particles from falling back to the substrate surface.

Polymers with small molecular weight form short chains and are not able to form polymeric network that would capture and trap particles. In contrast, polymers with large molecular weight form long polymer chains and also a polymeric network (or networks), as shown in FIG. 1. The polymeric chains and network captures the particles on the substrate surface and particles, which include impurities, floating in the cleaning solution of the cleaning material. The polymeric chains and network prevent particles captured in the cleaning material from falling on the substrate surface.

Further the cleaning material containing polymers is fluidic. The fluidic cleaning material deforms and/or glides around device features, such as the protruding feature 102 of FIG. 1. The cleaning materials do not damage the device features during substrate processing (or cleaning).

Figure 3C:
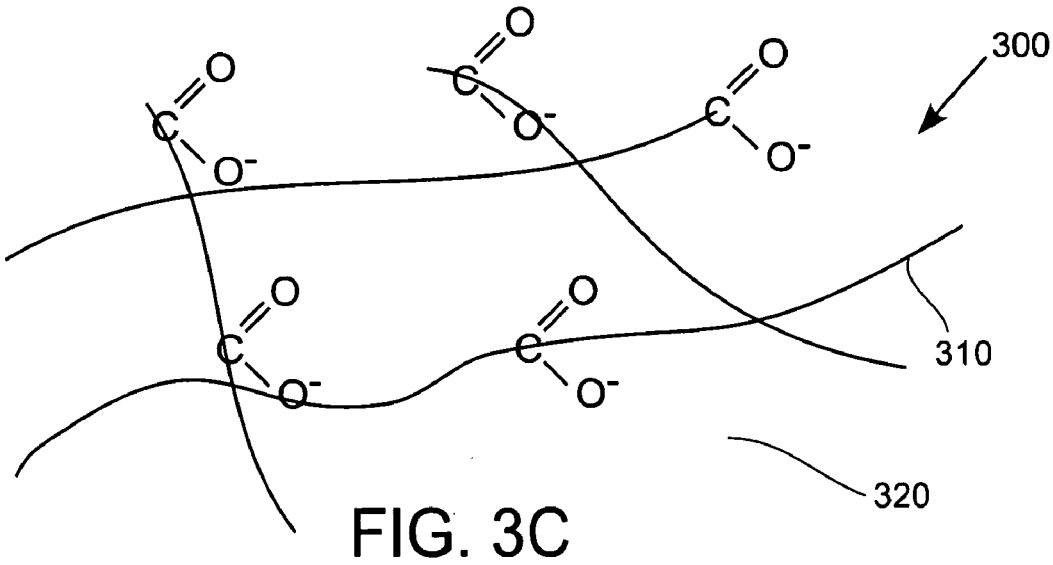
FIG. 3C shows polymeric chains and network of PAA having negatively charged —COOH functional group in a basic aqueous solution, in accordance with one embodiment of the present invention.

In addition to the polymers containing polar functional groups and having a large molecular weight to form long polymer chains and polymeric network, the polymers of the cleaning material can have other attributes that help in removing particles (or contaminants) from substrate surface. In one embodiment, the polymers contain functional groups that carry charge in an aqueous environment. FIG. 3C shows the —COOH functional group of PAA in a polymeric chains and network 310 that becomes negatively charged in an aqueous solution with pH greater than 3, the pKa (acid dissociation constant) of the carboxylic group in accordance with one embodiment of the present invention. The electrostatic charges, such as negatively charged PAA of FIG. 3C, of the polymeric chains and network repel one another to make the polymeric network more spread out. That is, the polymeric chains and network 310 on PAA in a cleaning material 300. The negative charges of the polymeric PAA repel one another to make the polymeric chains and network 310 more spread out in the cleaning solution 320, which contains water and other additives, and has a pH value greater than 7 (basic solution). Without the negative charges, the polymer molecules assume a closer packed conformation and the resulting polymeric network is weak or even fails to form. A polymeric network that is more spread out helps to improve PRE.

In addition, the charges of the functional groups of the polymers can enhance interaction with particles. Negative charges of the polymers can increase interactions with OH groups on particle surfaces, as shown in FIGS. 2D and 2E. Negative charges of the polymers can also help the cleaning material's removal from the substrate surface when the cleaning material is basic. As mentioned above, substrate surface is also negatively charged when the cleaning material is basic. The negative charges of the substrate surface and the negative charges of the polymers repel one another and hence help the cleaning material be removed from the substrate surface.

The polymeric network can be either positively charged or negatively charged to allow the charges on the polymeric network to repel one another and to make the polymeric network more spread out. Polymers with COOH functional groups becoming negatively charges are merely used as examples, other types of polymers with different functional groups can also become positively charged or negatively charged in a similar manner shown for PAA polymers.

Figure 3D:
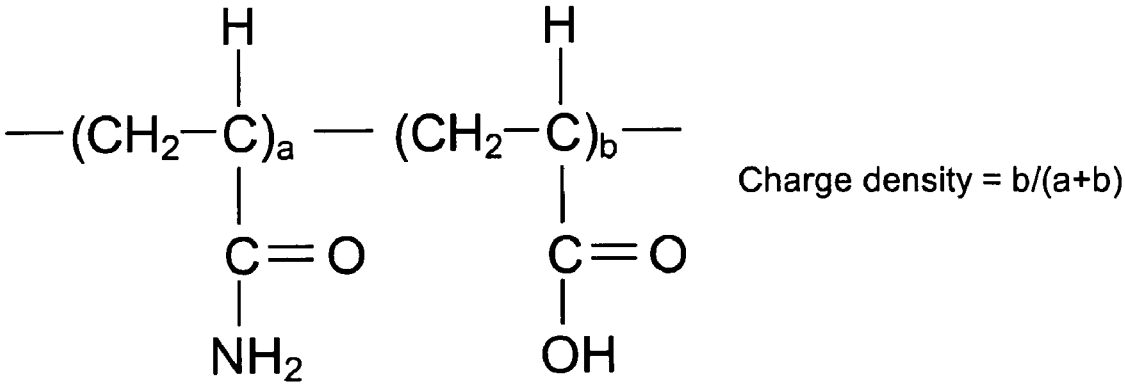
FIG. 3D shows the chemical structure of partially hydrolyzed PAM, in accordance with one embodiment of the present invention.

Table I shows PRE of cleaning materials made of 15M g/mol partially hydrolyzed PAM with different charge densities in the cleaning materials. FIG. 3D shows the chemical structure of partially hydrolyzed PAM. The weight percentage of PAM in the cleaning material is fixed at a value less than about 1%. The pH value of the cleaning material is about 10. The charge density of the solution is defined as the molar percentage of acrylic acid in the partially hydrolyzed PAM. The definition is shown in FIG. 3D.

TABLE I

Comparison of PREs for cleaning materials with different charge density.

| Charge Density (%) | PRE (%) |
|---|---|
| 0% | −117% |
| 22% | 84% |
| 42% | 86% |
| 64% | 88% |

The data in Table I show at charge density of 0, PRE is negative, which means that particles are added to the substrate surface, instead of being removed. The particles added are impurities included in the cleaning material, which is made of un-purified industrial-grade chemicals. As the charge density increases to 22%, PRE increases to 84%. As charge density further increases slightly to 42%, PRE increases to 86%. As charge density further increases to 64%, PRE increases slightly to 86%. The data show that the existence of charges in the cleaning materials is essential in the removal of particles on the substrate surface. Without charge density, the PRE is negative. PRE becomes positive when the cleaning material has charges. The increase in PRE is quite significant at charge density of 22%. At charge density at about 22% and beyond, the PRE increase to between about 84% to about 88%.

For cleaning materials at pH values greater than 7 (basic), such as 10, the substrate surface and the surface of the particles, such as oxide and nitride, are negatively charged. The negatively charged particles have been described in FIG. 2A above. The surface of substrate typically has at least a thin layer of oxide, if the top surface is not already an oxide layer, due to oxidation by atmospheric oxygen. The oxide layer of the surface behaves similar to surfaces of oxide particles and is negatively charged. If the polymeric chains and network are positively charged, the positively charged polymers would bond with the negatively charged particles. However, the positively charged polymers would also cling to the substrate surface and become hard to remove from the substrate surface, which is undesirable. If the polymers are negatively charged, the polymers would not cling to the substrate surface. Although the negatively charged polymers repel the negatively charged particles, other types of attractive interactions such as van der Waals forces, polar-polar molecular interaction and hydrogen bonds discussed above, between the polymers and particles would dominate and would be sufficient to pull particles off substrate surface. Some polymeric compounds, such as PAA, are more likely to become negatively charged in a basic solution than others. Depending on the pH values of the cleaning materials, the polymers could be positively charged or negatively charged. If the solution is highly acidic, or when pH<isoelectrical point of the substrate surface, the substrate surface will become positively charged. When this occurs, the polymers should be positively charged. Due to the importance of charge density in the cleaning material, it's important to choose polymers made of polymeric compound that is more likely to become positively or negatively charged, depending on the pH value of the cleaning solution (or cleaning material).

Examples of functional groups that the polymers can have to carry charges in the cleaning solution (or cleaning material) described above include, but not limited to, quaternary ammonium cation, carboxylic, azide, cyanate, sulfonic acid, nitrate, thiol, and phosphate groups, etc.

Some polymers, such as PAM, are very efficient in removing particles. However, PAM does not readily carry negative charges in a basic aqueous solution as PAA. To achieve good cleaning efficiency and to have sufficient charge density in the cleaning material, the polymers can be made of more than one polymeric compound. For example, the polymers can be a copolymer made of PAM and PAA. The weight percent of PAM and PAA in the polymers can be adjusted to achieve the best cleaning results. For example, a cleaning material can have a copolymers made of 90% PAM and 10% PAA. 10% PAA could be sufficient to provide charges to the copolymers in the basic cleaning material.

The descriptions above show that functional groups, molecular weight, which affects the formation of polymeric chains and network, and charge density of the polymers all play roles in the cleaning of particles on substrate surface. In addition to these factors, other factors also affect cleaning efficiency of cleaning materials. These other factors include, but not limited to, pH value of the cleaning material, the nature of the particles to be removed, concentration of polymers, shear/down forces applied by the cleaning material on the substrate, etc. Table II below shows the PREs of 3 different cleaning materials made of Carbopol 941™ PAA in a buffered ammonium solution (BAS). The molecular weights of PAA in these 3 cleaning materials are all 1.25M g/mol. The concentration of Carbopol 941™ PAA of X % (weight %) in the table is less than 1%.

TABLE II

Comparison of PREs for cleaning material with different concentration of Carbopol 941 ™ PAA polymers.

| Concentration (wt %) | PRE (%) |
|---|---|
| X % | 74% |
| 2.5X % | 89% |
| 5X % | 87% |

The data in Table II shows that PRE increases from about 74% to about 89% when the concentration of Carbopol 941™ increases from X % to 2.5X %. PRE stays about the same beyond 2.5X %. The data in Table II also suggest that if the concentration is too high, the PRE can be reduced.

Table III shows PREs of cleaning materials having partially hydrolyzed PAM as polymers at different molecular weight and charge density in solution 100, as defined above. The concentrations of PAM in the cleaning materials are all the same at a weight % less than 1%.

TABLE III

Comparison of PREs for cleaning materials with different molecular weight and charge densities.

| Molecular Weight (g/mol) | Charge Density (%) | PRE (%) |
|---|---|---|
| 0.5-1M | 30% | 6% |
| 5-6M | 30% | 89% |
| 15M | 22% | 84% |
| 18M | 32% | 95% |

The data in Table III show that PRE increases with molecular weight when the molecular weight is between about 0.5-1M g/mol to about 18M g/mol. At molecular weight of about 0.5-1M g/mol, PRE is about 6%. When molecular weight increases to about 5-6M g/mol, PRE increases to 89%. At molecular weight of 18M g/mol, PRE further increases to 95%. The charge density of the above mentioned cleaning materials are all about 30% (32% is close to 30%). These data show the effects of molecular weight on PREs.

However, at molecular weight of 15M g/mol and charge density of 22%, PRE is only about 84%. Based on the trend of PREs for cleaning materials with about 30% density (including 32% for 18M g/mol sample), PRE for cleaning material at 15M g/mol at about 30% charge density should be about 94%. The lowering of PRE from about 94% to about 84% for the 15M g/mol sample can only be explained by the lowering of charge density from about 30% to about 22%. This observation illustrates the importance of charge density.

As mention above, the polymers of a polymeric compound with large molecular weight forms a network in the cleaning liquid (or solution) 105. In addition, the polymers of a polymeric compound with large molecular weight are dispersed in the cleaning liquid 105. The liquid cleaning material 100 is gentle on the device structures on the substrate during cleaning process. The polymers 110 in the cleaning material 100 can slide around the device structures, such as structure 102, without making a forceful impact on the device structure 102. In contrast, hard brushes, and pads mentioned above would make unyielding contacts with the device structures and damage the device structures. Forces (or energy) generated by cavitation in megasonic cleaning and high-speed impact by liquid during jet spray can also damage the structure.

The polymers of a polymeric compound with high molecular weight form long chains of polymers, with or without cross-linking to form a polymeric network. As shown in FIG. 1, the polymers 110 come in contact with the contaminants, such as contaminants $\mathbf{120}_{I}$, $\mathbf{120}_{II}$, $\mathbf{120}_{III}$, $\mathbf{120}_{IV}$, on the patterned (or un-patterned) substrate surface and capture contaminants. After the contaminants are captured by the polymers, the contaminants become attached to the polymers and are suspended in the cleaning material. When the polymers in the cleaning material 100 are removed from the substrate surface, such as by rinsing, the contaminants attached to the polymers chains are removed from the substrate surface along with the polymer chains.

As described above, the polymers of a polymeric compound with large molecular weight are dispersed in the cleaning solution. Examples of the polymeric compound with large molecular weight include, but not limited to, acrylic polymers such as polyacrylamide (PAM), and polyacrylic acid (PAA), such as Carbopol 940™ and Carbopol 941™, poly-(N,N-dimethyl-acrylamide) (PDMAAm), poly-(N-isopropyl-acrylamide) (PIPAAm), polymethacrylic acid (PMAA), polymethacrylamide (PMAAm); polyimines and oxides, such as polyethylene imine (PEI), polyethylene oxide (PEO), polypropylene oxide (PPO) etc; Vinyl polymers such as Polyvinyl alcohol (PVA), polyethylene sulphonic acid (PESA), polyvinylamine (PVAm), polyvinyl-pyrrolidone (PVP), poly-4-vinyl pyridine (P4VP), etc; cellulose derivatives such as methyl cellulose (MC), ethyl-cellulose (EC), hydroxyethyl cellulose (HEC), carboxymethyl cellulose (CMC), etc; polysaccharides such as acacia (Gum Arabic), agar and agarose, heparin, guar gum, xanthan gum, etc; proteins such as albumen, collagen, gluten, etc. To illustrate a few examples of the polymer structure, polyacrylamide is an acrylate polymer ($—CH_2CHCONH_2$-)n formed from acrylamide subunits. Polyvinyl alcohol is a polymer ($—CH_2CHOH—$)m formed from vinyl alcohol subunits. Polyacrylic acid is a polymer ($—CH_2{=}CH—COOH—$)o formed from acrylic acid subunits. "n", "m", and "o" are integers. The polymers of a polymeric compound with large molecular weight either is soluble in an aqueous solution or is highly water-absorbent to form a soft gel in an aqueous solution. In one embodiment, the molecular weight of the polymeric compound is greater than 10,000 g/mol. In another embodiment, the molecular weight of the polymeric compound is between about 0.1M g/mol to about 100M g/mol. In another embodiment, the molecular weight of the polymeric compound is between about 1M g/mol to about 20M g/mol. In yet another embodiment, the molecular weight of the polymeric compound is between about 15M g/mol to about 20M g/mol. The weight percentage of the polymers in the cleaning material is between about 0.001% to about 20%, in one embodiment. In another embodiment, the weight percentage is between about 0.001% to about 10%. In another embodiment, the weight percentage is between about 0.01% to about 10%. In yet another embodiment, the weight percentage is between about 0.05% to about 5%. The polymers can dissolve in the cleaning solution, be dispersed completely in the cleaning solution, form liquid droplets (emulsified) in the cleaning solution, or form lumps in the cleaning solution.

Alternatively, the polymers can be copolymers, which are derived from two or more monomeric species. For example, the copolymers can include 90% of PAM and 10% of PAA and are made of monomers for PAM and PAA. In addition, the polymers can be a mixture of two or more types of polymers. For example, the polymers can be made by mixing two types of polymers, such as 90% of PAM and 10% of PAA, in the solvent.

In the embodiments shown in FIG. 1, polymers of a polymeric compound with large molecular weight are dissolved uniformly in the cleaning liquid, which can be a solution. The base liquid, or solvent, of the cleaning liquid is a polar liquid, such as water ($H_2O$). Other examples of polar solvent include isopropyl alcohol (IPA), dimethyl sulfoxide (DMSO), and dimethyl formamide (DMF). In one embodiment, the solvent includes more than one liquid and is a mixture of two or more liquid. For polymers with polarity, such as PAM, PAA, or PVA, the suitable solvent for the cleaning solution is a polar liquid, such as water ($H_2O$).

In another embodiment, the cleaning liquid (or cleaning solution) includes compounds other than the solvent, such as water, to modify the property of the cleaning material, which is formed by mixing the polymers in the cleaning solution. For example, the cleaning solution can include a buffering agent, which can be a weak acid or a weak base, to adjust the potential of hydrogen (pH) value of the cleaning solution and cleaning material formed by the cleaning solution. One example of the weak acid is citric acid. One example of the weak base is ammonium ($NH_4OH$). The pH values of the cleaning materials are between about 1 to about 12. In one embodiment, for front-end applications (before the deposition of copper and inter-metal dielectric), the cleaning material is basic. The pH values for front-end applications are between about 7 to about 12, in one embodiment. In another embodiment, the pH values for front-end applications are between about 8 to about 11. In yet another embodiment, the pH values for front-end applications are between about 8 to about 10. For backend processing (after deposition of copper and inter-metal dielectric), the cleaning solution is slightly basic, neutral, or acidic, in one embodiment. Copper in the backend interconnect is not compatible with basic solution with ammonium, which attacks copper. The pH values for backend applications are between about 1 to about 10, in one embodiment. In another embodiment, the pH values for backend applications are between about 1 to about 5. In yet another embodiment, the pH values for backend applications are between about 1 to about 2. In another embodiment, the cleaning solution includes a surfactant, such as ammonium dodecyl sulfate (ADS) to assist dispersing the polymers in the cleaning solution. In one embodiment, the surfactant also assist wetting of the cleaning material on the substrate surface. Wetting of the cleaning material on the substrate surface allows the cleaning material to come in close contact with the substrate surface and the particles on the substrate surface. Wetting improves cleaning efficiency. Other additives can also be added to improve surface wetting, substrate cleaning, rinsing, and other related properties.

Examples of buffered cleaning solution (or cleaning solution) include a buffered ammonium solution (BAS), which include basic and acidic buffering agents, such as 0.44 wt % of $NH_4OH$ and 0.4 wt % of citric acid, in the solution. Alternatively, the buffered solution, such as BAS, includes some amount of a surfactant, such as 1 wt % of ADS, to help suspend and disperse the polymers in the cleaning solution. A solution that contains 1 wt % of ADS, 0.44 wt % of NH3, and 0.4 wt % of citric acid is called solution "100". Both solution "100" and BAS have a pH value of about 10.

Figure 4A:
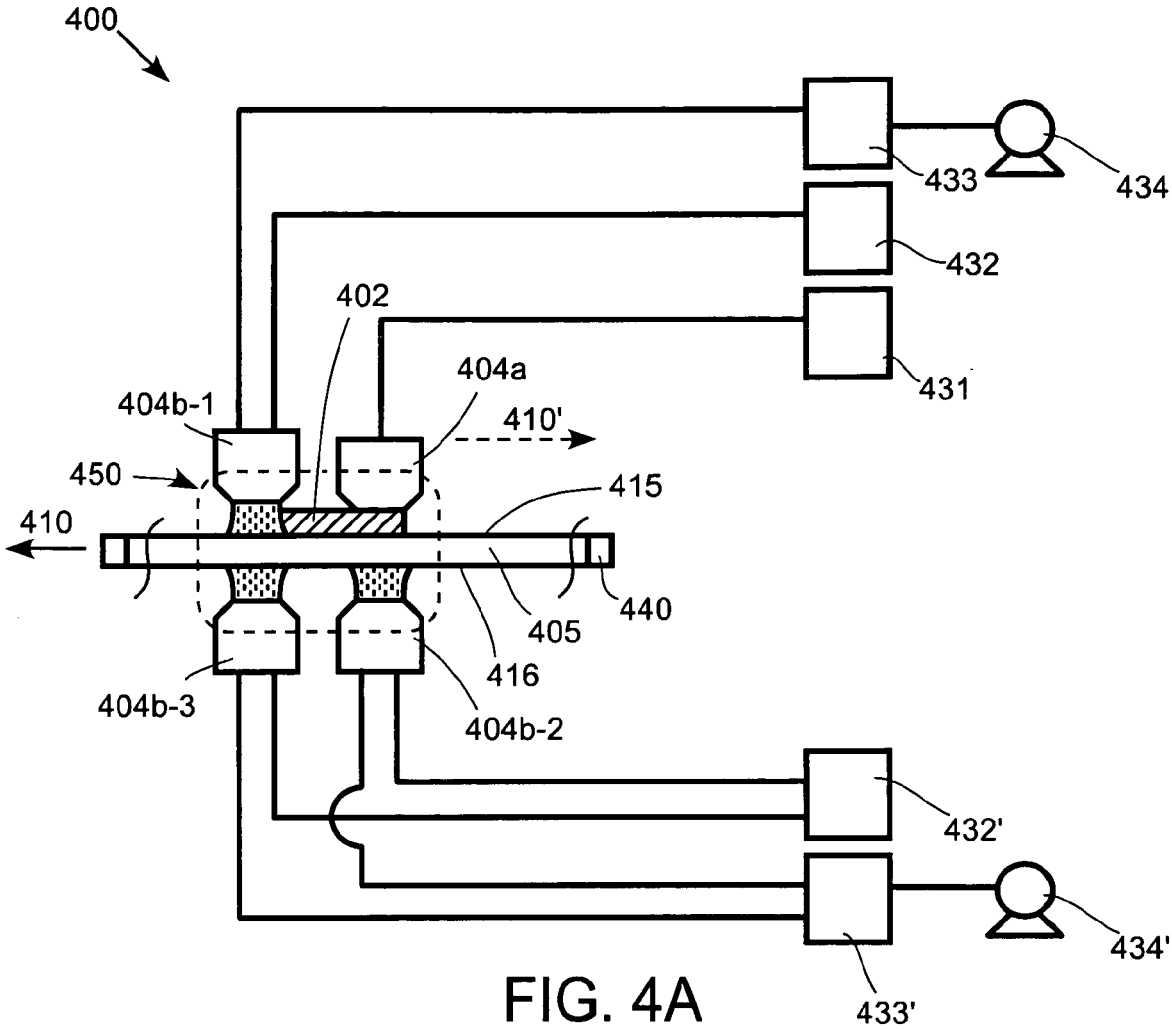
FIG. 4A shows a schematic diagram of an apparatus for cleaning contaminants from a substrate surface, in accordance with one embodiment of the present invention.

FIG. 4A shows an apparatus 400 for cleaning a substrate 450, in accordance with one embodiment of the present invention. The apparatus 400 includes a cleaning material dispense head 404*a* for dispensing a cleaning material on a surface 415 of the substrate 405. The cleaning material dispense head 404*a* is coupled to a cleaning material storage 431. In one embodiment, the cleaning material dispense head 404*a* is held in proximity (proximity head) to the surface 415 of the substrate 405 by an arm (not shown).

The apparatus also includes an upper rinse and dry head 404*b*-1 for rinsing and drying the surface 415 of the substrate 405. The upper rinse and dry head 404*b*-1 is coupled to a rinse liquid storage 432, which provides the rinse liquid for rinsing the substrate surface 415 covered by a film of cleaning material 402 dispensed by the cleaning material dispense head 404*a*. In addition, the upper rinse and dry head 404*b*-1 is coupled to a waste storage 433 and a vacuum 434. The waste storage 433 contains a mixture of cleaning material with contaminants removed from the substrate surface 415 and rinse liquid dispensed by the upper rinse and dry head 404*b*-1.

In one embodiment, substrate 405 moves under the cleaning material dispense head 404*a* and upper rinse and dry head 404*b*-1 in the direction 417. The surface 415 of substrate 405 is first covered with the film of cleaning material 402 and then rinsed and dried by the upper rinse and dry head 404*b*-1. Substrate 405 is held by a substrate holder 440. Alternatively, substrate 405 can be held steady (not moving) and the cleaning material dispense head 404*a* and upper rinse and dry head 404*b*-1 move in the direction 410', which is opposite to the direction 410.

In one embodiment, the cleaning material dispense head 404*a* and the rinse and upper dry head 404*b*-1 belong to two separate systems. Cleaning material is dispensed on the substrate 405 in a first system with the cleaning material dispense head and then moved to a second system with a rinse and dry apparatus. The rinse and dry apparatus can be an apparatus, such as rinse and dry head 404*b*-1, or other type of rinse and dry apparatus.

In one embodiment, below the substrate 405, there are two lower rinse and dry heads 404*b*-2 and 404*b*-3 to clean the other surface 416 of substrate 405. In one embodiment, the two lower rinse and dry heads 404*b*-2 and 404*b*-3 are coupled to a rinse liquid storage 432' and a waste storage 433' and a vacuum (pump) 434', as shown in FIG. 4A. In another embodiment, each of the lower rinse and dry heads 404*b*-2 and 404*b*-3 are coupled to separate rinse liquid storages and separate waste storages and separate vacuum pumps. In yet another embodiment, rinse liquid storages 432 and 432' are combined into one storage, and waste storages 433 and 433' are combined into one storage. In this embodiment, vacuum pumps 434 and 434' are also combined into one vacuum pump.

In one embodiment, rinse and dry head 404*b*-2 is directly below cleaning material dispense head 404*a*, and lower rinse and dry head 404*b*-3 is directly below upper rinse and dry head 404*b*-1. In another embodiment, the positions of the lower rinse and dry heads 404*b*-2 and 404*b*-3 are not related to the positions of cleaning material dispense head 404*a* and upper rinse and dry head 404*b*-1. In one embodiment, the upper rinse and dry head 404*b*-1, the lower rinse and dry heads 404*b*-2 and 404*b*-3 are held in proximity (proximity heads) to the surfaces 415 and 416, respectively, of the substrate 405 by an arm (not shown).

Figure 4B:
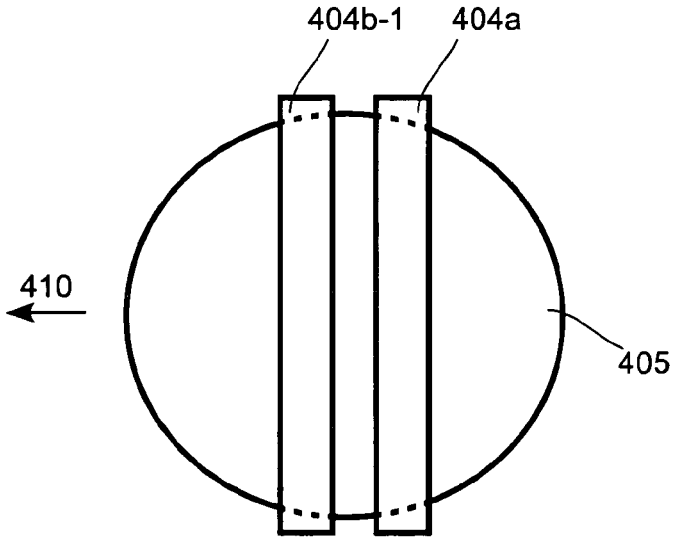
FIG. 4B shows a top schematic view of the apparatus of FIG. 4A, in accordance with one embodiment of the present invention.

FIG. 4B shows the top view of apparatus 400, in accordance with one embodiment of the present invention. The cleaning material dispense head 404*a* is parallel to the upper rinse and dry head 404*b*-1. The lower rinse and dry heads 404*b*-2 and 404*b*-3 (not shown) are below substrate 405 and cleaning material dispense head 404*a* and upper rinse and dry head 404*b*-1. In one embodiment, both the lower rinse and dry heads 404*b*-2 and 404*b*-3 are similar to the upper rinse and dry head 404*b*-1 and they are parallel to one another.

Figure 4C:
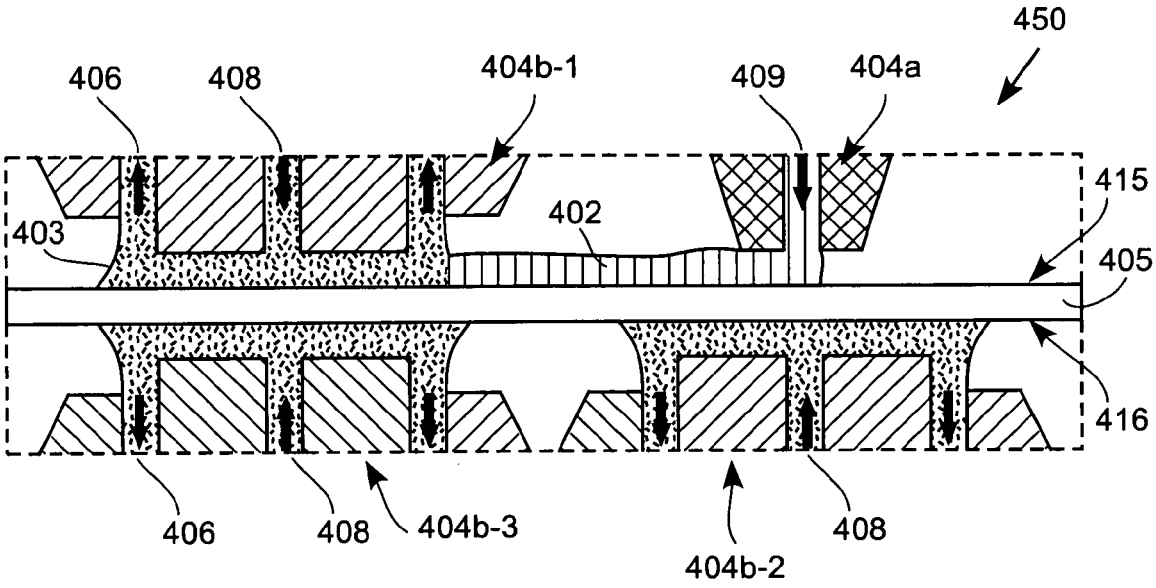
FIG. 4C shows a schematic diagram of a region 450 of FIG. 4A, in accordance with embodiment of the present invention.

FIG. 4C shows a process area 450 in FIG. 4A, in accordance with one embodiment of the present invention. The process area 450 illustrates one embodiment of fluid application to the substrate 405 from the cleaning material dispense head 404*a* and upper rinse and dry head 404*b*-1 and lower rinse and dry heads 404*b*-2 and 404*b*-3. In this embodiment, upper rinse and dry head 404*b*-1 and lower rinse and dry heads 404*b*-2 and 404*b*-3 rinse and dry the substrate 405. Upper rinse and dry head 404*b*-1 and lower rinse and dry heads 404*b*-2 and 404*b*-3 have a dispense port 408 and vacuum ports 406. In one embodiment, dispense port 408 is used to apply a rinse liquid, such as de-ionized water, to the substrate 405. A vacuum is drawn through vacuum ports 406 to remove fluid applied via dispense port 408. The fluid removed through the vacuum ports includes rinse liquid, cleaning material, and contaminants removed along with the cleaning material. Other types of rinse liquid can also be applied through dispense port 408 to rinse substrate 405.

FIG. 4C also shows the cleaning material dispense head 404*a* applying a film 402 of cleaning material 100 to the substrate 405. In one embodiment, the cleaning material dispense head 404*a* provides uniform flow delivery across the substrate 405. As described above in FIG. 4B, in one embodiment, the substrate 405 moves in the direction 410 between the upper applicator 404*a* and lower applicator 404*b*-2. Depending on the type of cleaning material being delivered and the speed of the substrate under the cleaning material dispense head 404*a*, cleaning material can be supplied to the substrate 405 through dispense port 409 at a speed between about 20 cc/min to 500 cc/min, in accordance with one embodiment of the present invention. The cleaning material dispense head 404*a* dispenses a film 402 of cleaning material 100 when turned on. In one embodiment, the fluid surface tension of the cleaning material prevents dripping or leaking of the cleaning material from the upper applicator 404*a* when the flow of the cleaning material through the manifold (not shown) is turned off. Under the rinse and dry head, there is a volume 403 of material, which consists rinse liquid, cleaning material and contaminants removed from the substrate surface.

In one embodiment, the cleaning material dispense head 404*a* in FIGS. 4A-4C, through the action of dispensing of the cleaning material, provides a down-ward force to cleaning material and to the substrate surface. The cleaning material can be pressed out of the cleaning material dispense head 404*a* by air pressure or by a mechanical pump. In another embodiment, the applicator 404*a* provides a down-ward force on the cleaning material on the substrate surface by a down-ward mechanical force. In one embodiment, the movement of the substrate 405 under the applicator 404*a* in the direction 410, provides a sheer force to the cleaning material and to the substrate surface. The downward and sheer forces assist the cleaning material in removing contaminants from the substrate surface 415.

Figure 4D:
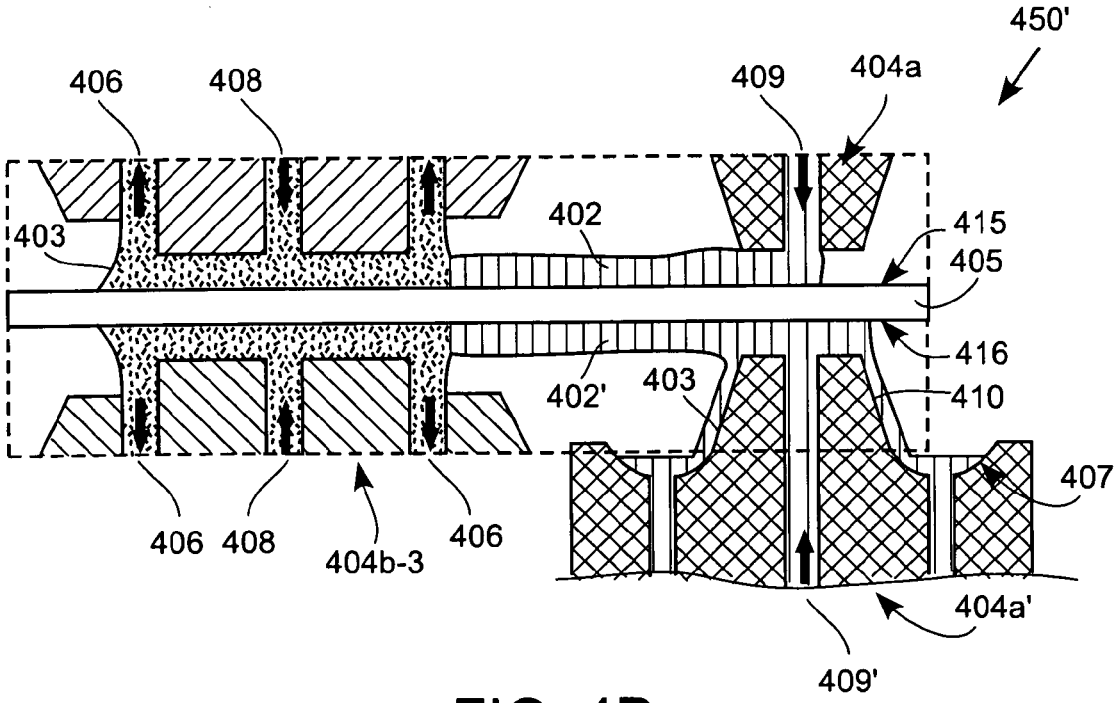
FIG. 4D shows a schematic of a diagram a process area 450', which is similar to the process area 450 of FIG. 4A, in accordance with one embodiment of the present invention.

FIG. 4D shows a schematic of a diagram a process area 450', which is similar to the process area 450 of FIG. 4A, in accordance with one embodiment of the present invention. In this embodiment, there are an upper cleaning material dispense head 404*a* and a lower cleaning material dispensing head 404*a*'. The upper cleaning material dispensing head 404*a* has been described above in FIGS. 4A-4C. The lower cleaning material dispensing head 404*a*' also dispenses a film 402' of a cleaning material 100' on the lower side of substrate 405. The lower cleaning material dispensing head also has a dispense port 409' for dispensing the cleaning material 100'. The dispensed cleaning material 100' forms a film 402' on the lower side of substrate 405. In this embodiment, the lower cleaning material dispensing head 404*a*' applies a film 402' of cleaning material 100' to the lower surface 416 of substrate 405 in a similar fashion to previously discussed upper cleaning material dispensing head 404*a*. In one embodiment, cleaning materials 100 and 100' are identical while in another embodiment, cleaning materials 100 and 100' are different.

Some of the cleaning material flows to the sidewall of the lower dispense head 404*a*' of dispense port 409' to form a film 402'. At the lower end of the dispense port 409' there is a collector 407 for collecting cleaning material that flow to the side wall 410 surrounding dispense port 409' of the lower dispense head 404*a*'. In one embodiment, the collector 407 has a wider opening near the top with a narrow channel near the bottom. In one embodiment, the upper dispense head 404*a* and lower dispense head 404*a*' are both coupled to the cleaning material storage 431, shown in FIG. 4A, if cleaning material 100 is the same as cleaning material 100'. In another embodiment the lower dispense head 404*a*' is coupled to another storage (not shown) of cleaning material 100', which can be the same as or different from cleaning material 100. The over-flow cleaning material collected by collector 407 can be supplied to the cleaning material storage used to supply cleaning material 100' to dispense port 409' or to a different cleaning material storage (not shown).

Upper rinse and dry head 404*b*-1 and lower rinse and dry head 404*b*-3 in FIG. 4D are similar to the applicators 404*b*-1 and 404*b*-3 described in FIGS. 4A and 4C. The substrate 405 is cleaned and dried as it passes between upper applicator 404*b*-1 and lower applicator 404*b*-3. A rinse agent is applied to the substrate 405 through ports 408. In one embodiment, the rinse agent 404 is de-ionized water. In another embodiment, the rinse agent 404 is a mixture of deionzied water and isopropyl alcohol. A vacuum is drawn through ports 406 to remove the rinse agent 404 along with fluids 402 and 402' from the substrate 405.

Figure 4E:
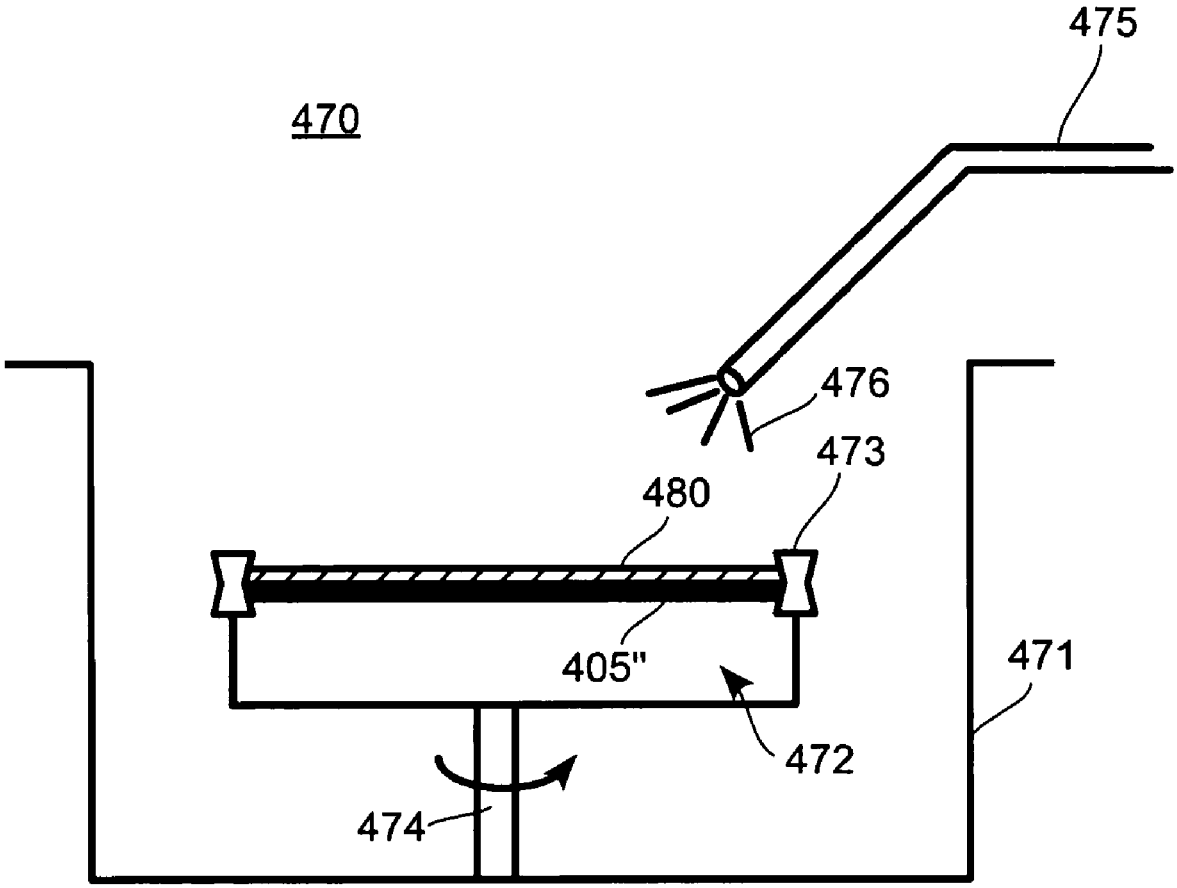
FIG. 4E shows a schematic diagram of a rinse and dry apparatus 470, in accordance with one embodiment of the present invention.

Alternatively, the cleaning apparatus 4A does not have rinse and dry heads 404*b*-1, 404*b*-2, and 404*b*-3. After the cleaning material has been applied on substrate 405. The substrate can be moved to another apparatus for rinsing and drying. FIG. 4E shows a schematic diagram of an embodiment of a rinse and dry apparatus 470. Apparatus 470 has a container 471 that houses a substrate support assembly 472. The substrate support assembly 472 has a substrate holder 473 that supports a substrate 405", which has a layer 480 of cleaning material 100. The substrate support assembly 472 is rotated by a rotating mechanism 474. The apparatus 470 includes a rinse liquid dispenser 475, which can dispense rinse liquid 476 on the substrate surface to clean the substrate surface. In one embodiment, the rinse liquid is de-ionized water (DIW). In another embodiment, the dispenser 475 dispenses a rinsing solution, such as $NH_4OH$ in DIW, on the substrate surface to hydrolyze the cleaning material to enable the cleaning material to be lifted off the substrate surface. Afterwards, the same dispenser 470 or a different dispenser (not shown) can dispense DIW to remove the cleaning solution from the substrate surface.

Figure 5:
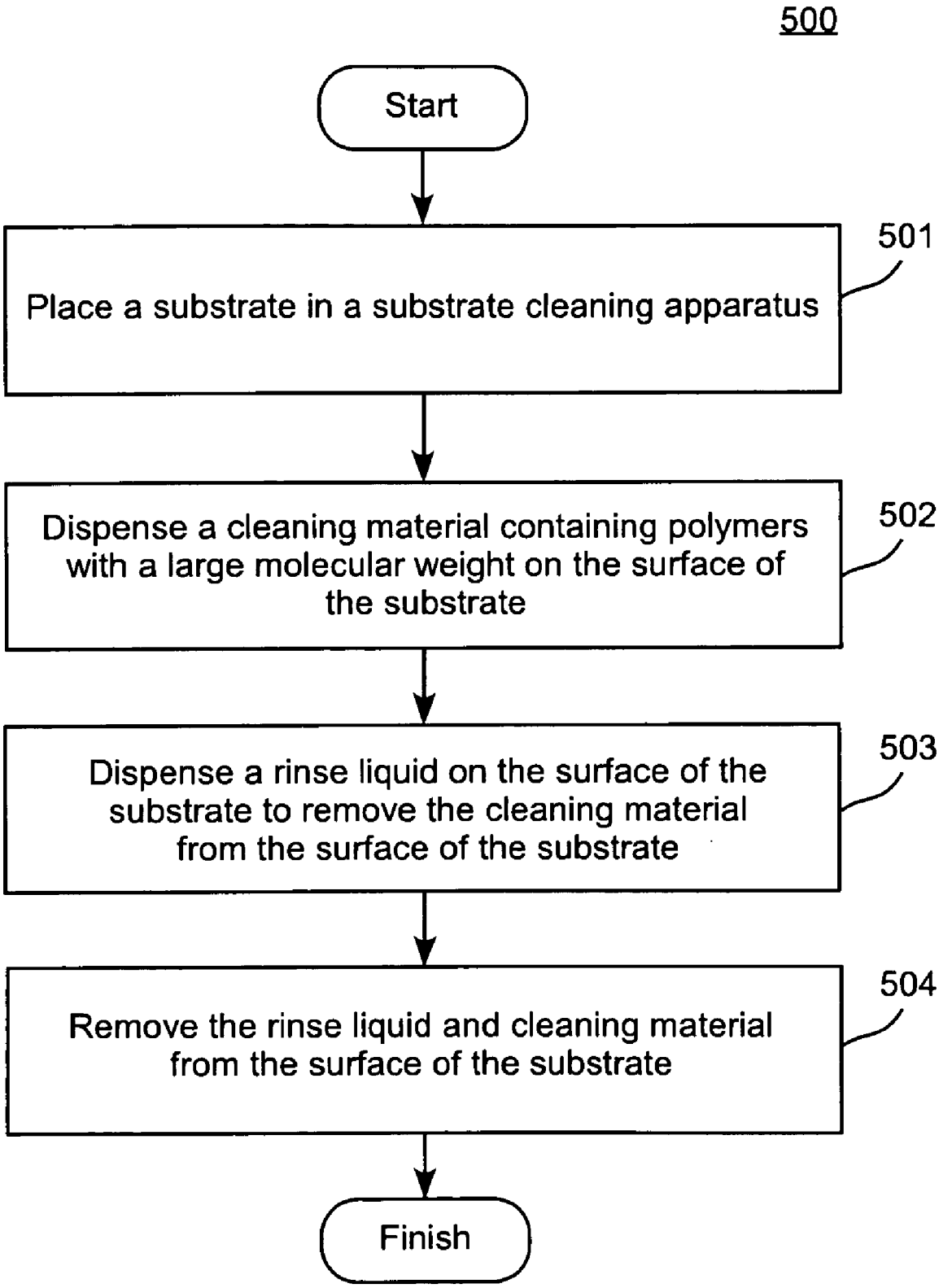
FIG. 5 shows a process flow of using a cleaning material to clean a substrate surface, in accordance with one embodiment of the present invention.

FIG. 5 shows a process flow 500 of cleaning a substrate using a cleaning material containing polymers with a large molecular weight, in accordance with one embodiment of the present invention. In one embodiment, the substrate is a patterned substrate with features protruding from the substrate surface. In another embodiment the substrate is a blank wafer without patterns. The chemicals in the cleaning material have been described above. At operation 501, a substrate to be cleaned is place in a cleaning apparatus. At operation 502, the cleaning material is dispensed on the surface of the substrate. At mentioned above, the cleaning material contains polymers with a large molecular weight, both of which are mixed in a cleaning liquid. At operation 503, a rinse liquid is dispensed on the surface of the patterned substrate to rinse off the cleaning material. The rinse liquid is described above. At operation 504, the rinse liquid and the cleaning material are removed from the surface of the substrate. In one embodiment, after the rinse liquid is applied on the substrate surface, the rinse liquid, the cleaning material, and the contaminants on the substrate surface are removed from the surface of the patterned substrate by vacuum. The contaminants on the patterned substrate to be removed can be essentially any type of surface contaminant associated with the semiconductor wafer fabrication process, including but not limited to particulate contamination, trace metal contamination, organic contamination, photoresist debris, contamination from wafer handling equipment, and wafer backside particulate contamination.

In one embodiment, the method includes an operation for controlling a flow rate of the cleaning material over the substrate to control or enhance movement of the solid cleaning material and/or contaminant away from the substrate. The method of the present invention for removing contamination from a substrate can be implemented in many different ways so long as there is a means for applying a force to the solid components of the cleaning material such that the solid components establish an interaction with the contaminants to be removed.

Alternatively, before the operation 503 of substrate rinse, the substrate with the cleaning material, that contains dislodged contaminants, can be cleaned with a final clean using chemical(s) that facilitates the removal of all the cleaning material along with the contaminants from the substrate surface. For example, if the cleaning material contains carboxylic acid solids, $NH_4OH$ diluted in DIW could be used to remove carboxylic acid off the substrate surface. $NH_4OH$ hydrolyzes (or ionizes by deprotonating) the carboxylic acid and enables the hydrolyzed carboxylic acid to be lifted off the substrate surface. Alternatively, a surfactant, such as ammonium dodecyl Sulfate, $CH_3(CH_2)_{11}OSO_3NH_4$, can be added in DIW, to remove carboxylic acid solids off the substrate surface.

The rinse liquid for the rinse operation 503 can be any liquid, such as DIW or other liquid, to remove the chemical(s) used in the final clean, if such an operation exists, or cleaning material, without the final clean operation, from the substrate surface. The liquid used in rinse operation should leave no chemical residue(s) on the substrate surface after it evaporates.

The cleaning materials, apparatus, and methods discussed above have advantages in cleaning patterned substrates with fine features without damaging the features. The cleaning materials are fluidic, either in liquid phase, or in liquid/gas phase (foam), and deform around device features; therefore, the cleaning materials do not damage the device features. The cleaning materials in liquid phase can be in the form of a liquid, a sol, or a gel. The cleaning materials containing polymers of a polymeric compound with large molecular weight capture the contaminants on the substrate. In addition, the cleaning materials entrap the contaminants and do not return the contaminants to the substrate surface. The polymers of a polymeric compound with large molecular weight form long polymer chains, which can also be cross-linked to form a network of polymers. The long polymer chains and/or polymer network show superior capabilities of capturing and entrapping contaminants, in comparison to conventional cleaning materials.

As discussed above, to assist removing of particles from the wafer (or substrate) surfaces, the polymeric compound of the polymers can contain a polar functional group, which can establish polar-polar molecular interaction with hydrolyzed particles on the wafer surface. In addition, the polar functional group can also establish hydrogen bonds with the hydrolyzed particles on the wafer surface. The van der Waals forces between the polymers and the particles help remove the particles from the wafer surface.

In addition, the cleaning materials entrap the contaminants and do not return the contaminants to the substrate surface. The polymers of a polymeric compound(s) with a large molecular weight form long polymer chains, which can also be cross-linked to form a network (or polymeric network). The long polymer chains and/or polymer network show superior capabilities of capturing and entrapping contaminants, in comparison to conventional cleaning materials. As a result, cleaning materials, in fluid form, including such polymers show excellent particle removal performance. The captured or entrapped contaminants are then removed from the surface of the substrate.

The polymeric compound(s) of the polymers may also include a functional group that carries charge in the cleaning solution. The charge of the functional group of the polymers repel one another and help the polymeric chains and network to be more spread out and hence improves the particle removal efficiency.

The cleaning material is substantially free of non-deformable particles (or abrasive particles), before it is applied on the substrate surface to remove contaminants or particles from the substrate surface. Non-deformable particles are hard particles, such as particles in a slurry or sand, and can damage fine device features on the patterned substrate. During the substrate cleaning process, the cleaning material would collect contaminants or particles from the substrate surface. However, no non-deformable particles have been intentionally mixed in the cleaning material before the cleaning material is applied on the substrate surface for substrate cleaning.

Although the embodiments above describe materials, methods, and systems for cleaning patterned substrates, the materials, methods, and systems can also be used to clean un-patterned (or blank) substrates.

Although the discussion above is centered on cleaning contaminants from patterned wafers, the cleaning apparatus and methods can also be used to clean contaminants from un-patterned wafers. In addition, the exemplary patterns on the patterned wafers discussed above are protruding lines, such as polysilicon lines or metal lines. However, the concept of the present invention can apply to substrates with recessed features. For example, recess vias after CMP can form a pattern on the wafer and a most suitable design of channels can be used to achieve best contaminant removal efficiency.

A substrate, as an example used herein, denotes without limitation, semiconductor wafers, hard drive disks, optical discs, glass substrates, and flat panel display surfaces, liquid crystal display surfaces, etc., which may become contaminated during manufacturing or handling operations. Depending on the actual substrate, a surface may become contaminated in different ways, and the acceptable level of contamination is defined in the particular industry in which the substrate is handled.

Although a few embodiments of the present invention have been described in detail herein, it should be understood, by those of ordinary skill, that the present invention may be embodied in many other specific forms without departing from the spirit or scope of the invention. Therefore, the present examples and embodiments are to be considered as illustrative and not restrictive, and the invention is not to be limited to the details provided therein, but may be modified and practiced within the scope of the appended claims.

What is claimed is:

1. A cleaning material applied on a surface of a substrate without chemical mechanical polishing (CMP) for removing particles from the surface, comprising:

a solvent;

a buffering agent to change a potential of hydrogen (pH) value of the cleaning material, wherein the buffering agent and the solvent form a cleaning solution; and polymers of a polymeric compound with a molecular weight greater than 10,000 g/mol, wherein the polymers become soluble in the cleaning solution to form the cleaning material, the solubilized polymers forming long polymeric chains and network to capture and entrap at least some of the particles from the surface of the substrate, and wherein the polymeric compound has a polar functional group, the polar functional group of the polymeric compound establishing van der Waals force with the particles hydrolyzed in the solvent to help remove the particles from the surface of the substrate, wherein the polymeric compound has a functional group that carries charge in the cleaning solution, the charge carried by the functional group of the polymeric compound improves particle removal efficiency by increasing interactions with surface particles and makes the polymeric network more spread out;

wherein the cleaning material deforms around device features on the surface of the substrate when a force is applied on the cleaning material covering the substrate, the cleaning material being applied on the surface of the patterned substrate to remove contaminants from the surface without damaging the device features on the surface;

wherein the polymeric compound has a functional group that carries negative charge in the cleaning solution when it is basic and aqueous, the negative charge increasing interactions with OH groups on particle surfaces and helping the cleaning material's removal from the substrate surface;

wherein the polymeric compound includes partially hydrolyzed polyacrylamide (PAM) having a molar percentage of acrylic acid of about 22% to 42%.

2. The cleaning material of claim 1, wherein the solvent is selected from the group consisting of water, isopropyl alcohol (IPA), dimethyl sulfoxide (DMSO), dimethyl formamide (DMF), or a combination thereof.

3. The cleaning material of claim 1, wherein the molecular weight is between about 10,000 g/mol to about 100M g/mol.

4. The cleaning material of claim 1, wherein the weight percent of the polymers in the cleaning material is between about 0.001% to about 10%.

5. The cleaning material of claim 1, further comprising:

a surfactant to assist in dispersing or wetting the polymers in the cleaning solution.

6. The cleaning material of claim 1, wherein the pH value is between 7 and about 12 for front-end applications.

7. The cleaning material of claim 1, wherein the pH value is between about 1 to about 10 for backend application.

8. The cleaning material of claim 1, wherein polymers forming long polymeric chains and network at least in part are influenced to capture and entrap particles by van der Waals force of polar-polar molecular interaction and hydrogen bonds between the hydrolyzed particles and the polar functional group of the polymeric compound of the polymers.

9. The cleaning material of claim 1, wherein the cleaning material is free of non-deformable particles before the cleaning material is applied on the surface of the patterned substrate.

10. The cleaning material of claim 1, wherein the molecular weight of PAM is greater than or equal to 500,000 g/mol.

11. A cleaning material applied on a surface of a substrate without chemical mechanical polishing (CMP) for removing particles from the surface, comprising:

water;

a buffering agent to change a potential of hydrogen (pH) value of the cleaning material, wherein the buffering agent and the water form a aqueous cleaning solution; and polymers of a polymeric compound with a molecular weight greater than 10,000 g/mol, wherein the polymers become soluble in the aqueous cleaning solution to form the cleaning material, the solubilized polymers forming long polymeric chains and network to capture and entrap at least some of the particles from the surface of the substrate, and wherein the polymeric compound has a functional group carrying charge in the aqueous cleaning solution, the charge carried by the functional group of the polymeric compound improves particle removal efficiency by making the polymeric chains and network more spread out in the aqueous cleaning solution and by increasing interactions with surface particles;

wherein the cleaning material deforms around device features on the surface of the substrate when a force is applied on the cleaning material covering the substrate, the cleaning material being applied on the surface of the patterned substrate to remove contaminants from the surface without damaging the device features on the surface;

wherein the polymeric compound has a functional group that carries negative charge in the cleaning solution when it is basic and aqueous, the negative charge increasing interactions with OH groups on particle surfaces and helping the cleaning material's removal from the substrate surface;

wherein the polymeric compound includes partially hydrolyzed polyacrylamide (PAM) having a molar percentage of acrylic acid of about 22% to 42%.

12. A cleaning material applied on a surface of a substrate without chemical mechanical polishing (CMP) for removing particles from the surface, comprising:

water;

a buffering agent to change a potential of hydrogen (pH) value of the cleaning material, wherein the buffering agent and the water form a aqueous cleaning solution; and polymers of a polymeric compound with a molecular weight greater than 10,000 g/mol, wherein the polymers become soluble in the aqueous cleaning solution to form the cleaning material, the solubilized polymers forming long polymeric chains and network to capture and entrap at least some of the particles from the surface of the substrate, and wherein the polymeric compound has a functional group carrying charge in the aqueous cleaning solution, the charge carried by the functional group of the polymeric compound improves particle removal efficiency by making the polymeric chains and network more spread out in the aqueous cleaning solution and by increasing interactions with surface particles, and wherein the polymeric compound has a polar functional group, the polar functional group of the polymeric compound establishing van der Waals force with the particles hydrolyzed in the aqueous cleaning solution to help remove the particles from the surface of the substrate;

wherein the cleaning material deforms around device features on the surface of the substrate when a force is applied on the cleaning material covering the substrate, the cleaning material being applied on the surface of the patterned substrate to remove contaminants from the surface without damaging the device features on the surface;

wherein the polymeric compound has a functional group that carries negative charge in the cleaning solution when it is basic and aqueous, the negative charge increasing interactions with OH groups on particle surfaces and helping the cleaning material's removal from the substrate surface;

wherein the polymeric compound includes partially hydrolyzed polyacrylamide (PAM) having a molar percentage of acrylic acid of about 22% to 42%.

13. A cleaning material applied on a surface of a substrate without chemical mechanical polishing (CMP) for removing particles from the surface, comprising:

a solvent;

a buffering agent to change a potential of hydrogen (pH) value of the cleaning material, wherein the buffering agent and the solvent form a cleaning solution; and polymers of one or more polymeric compounds with a molecular weight greater than 10,000 g/mol, wherein the polymers become soluble in the cleaning solution to form the cleaning material, the solubilized polymers forming long polymeric chains and network to capture and entrap at least some of the particles from the surface of the substrate, and wherein the polymeric compound has a polar functional group, the polar functional group of the polymeric compound establishing van der Waals force with the particles hydrolyzed in the solvent to help remove the particles from the surface of the substrate, wherein the polymeric compound has a functional group that carries charge in the cleaning solution, the charge carried by the functional group of the polymeric compound improves particle removal efficiency by increasing interactions with surface particles and makes the polymeric network more spread out;

wherein the cleaning material deforms around device features on the surface of the substrate when a force is applied on the cleaning material covering the substrate, the cleaning material being applied on the surface of the patterned substrate to remove contaminants from the surface without damaging the device features on the surface;

wherein one or more of the polymeric compounds include a functional group that carries negative charge in the cleaning solution when it is basic and aqueous, the negative charge increasing interactions with OH groups on particle surfaces and helping the cleaning material's removal from the substrate surface;

wherein the polymeric compounds include partially hydrolyzed polyacrylamide (PAM) having a molar percentage of acrylic acid of about 22% to 42%.

14. The cleaning material of claim 13, wherein the polymeric compounds include one or more of acrylic polymers, polyimines and oxides, vinyl polymers, cellulose derivatives, polysaccharides, and proteins.

15. The cleaning material of claim 14, wherein the acrylic polymers include one or more of polyacrylamide (PAM), polyacrylic acid (PAA), copolymers of PAM and PAA, poly-(N,N-dimethyl-acrylamide) (PDMAAm), poly-(N-isopropyl-acrylamide) (PIPAAm), polymethacrylic acid (PMAA), polymethacrylamide (PMAAm);

wherein the polyimines and oxides include one or more of polyethylene imine (PEI), polyethylene oxide (PEO), polypropylene oxide (PPO);

wherein the vinyl polymers include one or more of polyvinyl alcohol (PVA), polyethylene sulphonic acid (PESA), polyvinylamine (PVAm), polyvinyl-pyrrolidone (PVP), poly-4-vinyl pyridine (P4VP);

wherein the cellulose derivatives include one or more of methyl cellulose (MC), ethyl-cellulose (EC), hydroxyethyl cellulose (HEC), carboxymethyl cellulose (CMC);

wherein the polysaccharides include one or more of acacia, agar and agarose, heparin, guar gum, xanthan gum; and wherein the proteins include one or more of albumen, collagen, and gluten.

16. The cleaning material of claim 13, wherein the polar functional group includes one or more of an amine, amide, hydroxyl, carbonyl, sulfonyl, sulfinyl, or sulfhydryl group.

17. The cleaning material of claim 13, wherein one or more of the polymeric compounds includes a functional group that carries charge in the cleaning solution, and the functional group includes one or more of quaternary ammonium cation, carboxylic, azide, cyanate, sulfonic acid, nitrate, thiol, or phosphate group.

18. The cleaning material of claim 13, wherein the polymers include copolymers made of more than one polymeric compound.

19. The cleaning material of claim 13, wherein the polymers include copolymers made of more than one polymeric compound, and wherein one of the polymeric compounds has the functional group that carry charge in the cleaning solution and another one of the polymeric compounds has the polar functional group.

20. The cleaning material of claim 19, wherein the polymeric compound that has the functional group that carry charge in the cleaning solution that is basic and aqueous is polyacrylic acid (PAA) and the polymeric compound that has a polar functional group is PAM.

* * * * *